US007003992B1

(12) United States Patent
Scribner

(10) Patent No.: US 7,003,992 B1
(45) Date of Patent: Feb. 28, 2006

(54) DOOR HINGE DEADBOLT

(76) Inventor: Paul Dominic Scribner, 19140 Goldwin St., Southfield, MI (US) 48075-7220

( * ) Notice: Subject to any disclaimer, the term of this patent is extended or adjusted under 35 U.S.C. 154(b) by 91 days.

(21) Appl. No.: 10/379,922

(22) Filed: Mar. 5, 2003

Related U.S. Application Data

(60) Provisional application No. 60/377,807, filed on May 6, 2002.

(51) Int. Cl.
*E05C 19/18* (2006.01)

(52) U.S. Cl. ..... 70/120; 70/134; 70/DIG. 64; 292/259 R; 292/DIG. 17

(58) Field of Classification Search ..... 292/336.3, 292/138, DIG. 17, 259 R; 70/DIG. 64, DIG. 65, 70/120, 134
See application file for complete search history.

(56) References Cited

U.S. PATENT DOCUMENTS 1,340,398 A * 5/1920 O'Brien ..... 292/335
1,846,364 A 2/1932 Schlage
1,965,723 A * 7/1934 Rupp ..... 292/273
2,042,021 A 5/1936 Schlage
2,584,088 A * 1/1952 Floyd ..... 292/34
3,336,769 A * 8/1967 Russell et al. ..... 70/134
3,606,422 A 9/1971 Hennessy
3,699,788 A 10/1972 Aerlachetal
3,811,150 A * 5/1974 Chalmers ..... 16/352
3,899,905 A * 8/1975 Walters ..... 70/91
4,272,974 A 6/1981 Hennessy
4,288,944 A * 9/1981 Donovan ..... 49/395
4,593,542 A 6/1986 Rotondi et al.
4,656,849 A 4/1987 Rotondi et al.
4,823,510 A * 4/1989 Amos ..... 49/383
5,154,461 A * 10/1992 Prescott et al. ..... 292/346
5,427,422 A * 6/1995 Madlener et al. ..... 292/264
5,765,412 A 6/1998 Koskela et al.
5,769,473 A * 6/1998 Sovis ..... 292/340
6,431,621 B1 * 8/2002 De Groot ..... 292/346
6,523,375 B1 2/2003 Beatty

* cited by examiner

*Primary Examiner*—Gary Estremsky
(74) *Attorney, Agent, or Firm*—Ronald R. Kilponen

(57) ABSTRACT

A lock for installation on a pre-existing or new door is shown. The lock extends from the door through the hinge of the door and into the door frame and alternatively into the door frame and stud. This arrangement provides increased security and resistance against breaking in the door to gain unauthorized entry.

19 Claims, 6 Drawing Sheets

24
17
26
28
16
30
36
14

18
22
16
20
17
38
32
S
S
F
F
21
24
30
34
14
11

DOOR HINGE DEADBOLT

PRIORITY

This application claims the benefit of U.S. Provisional Application No. 60/377,807 filed on May 6, 2002.

FIELD

The present version of this invention relates generally to the field of improving security in doors.

BACKGROUND

This invention relates to improvements in security for doors, and more particularly to a device that helps prevent unwanted persons from entering a home or business. This device helps prevent unwanted persons from gaining access by improving the security of the standard door by using the door hinge and a dead bolt.

Burglary and forced entry unfortunately occur more often then we would care to think about. Many times criminals will kick in a door forcing the door knob from the frame of the door to gain access to the home or other building. It should be pointed out that when a door is forced open, many times the only thing keeping the door locked is the knob that sticks into the frame. It is relatively easy to break in a door in that only has a door knob locking it.

Some persons have used different devices to prevent unwanted access to homes and buildings. Some have used dead bolts which are typically mounted above or below the door knob. Dead bolts on the same side of the door as the door knob suffer from the same problem as the door knob itself. The framing that the door knob and the standard deadbolt engage is too thin to defer a seasoned attack by a persistent unwanted guest.

Some persons, then use multiple deadbolts or other means to discourage access. Multiple deadbolts require that the user thus have as many keys as deadbolts unless they are all keyed alike. Multiple deadbolts could mean multiple keys which are bulky, difficult to carry, and can be easily misplaced. If all the deadbolts are keyed the same, the intruder needs to only obtain one key to open the door and this defeats the purpose of multiple deadbolts.

Many other devices exist in the prior art to prevent unwanted access. Many of these are complicated, expensive, require time consuming retrofits, special skills to install, may be impracticable to the point that users don't use them and some just don't look very aesthetically appealing.

For the foregoing reasons, there is a need for a device that the average consumer could retro-fit to an existing door with commonly available tools or a manufacturer could easily include at the manufacturing level to enhance the security of the existing doors.

SUMMARY

In view of the foregoing disadvantages inherent in the field of door security there is a need for a new type of device that can be relatively easily installed by the average consumer with common tools, does not look unattractive, is not overly complicated and enhances the security of the door.

A first object of this embodiment of the invention is to provide a device that enhances the security of a door.

Another object of this embodiment of the invention is to provide a device that can be relatively easily installed on existing doors.

It is another object of this embodiment of the invention is to have a device that can be installed by the average consumer with common tools.

It is yet another object of this embodiment of the invention to provide a device that looks relatively attractive and corresponds with the look that consumers are used to seeing on doors.

It is a still further object of this embodiment of the invention to provide a device that discourages the unwanted entrance through a door.

Another object of this embodiment of the invention is to provide a device that can be installed on newly manufactured doors.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

The following patents disclose various embodiments of dead bolt locks. These dead bolt locks and actuation structure were well known in the background art at the time of this application filing. These patents are hereby incorporated by reference into this application since the relevant structure of this background art is presumed to be part of the knowledge of one having ordinary skill in the art. U.S. Pat. No. 1,846,364 Schlage, U.S. Pat. No. 2,042,021 Schlage, U.S. Pat. No. 3,606,422 Hennessy, U.S. Pat. No. 3,699,788 Gerlach et al, U.S. Pat. No. 4,272,974 Hennessy, U.S. Pat. No. 4,593,542 Rotondi et al, U.S. Pat. No. 4,656,849 Rotondi et al, U.S. Pat. No. 5,765,412 Koskela et al, U.S. Pat. No. 6,523,375 Beatty.

DETAILED DESCRIPTION OF THE PREFERRED EMBODIMENTS

Figure 1:
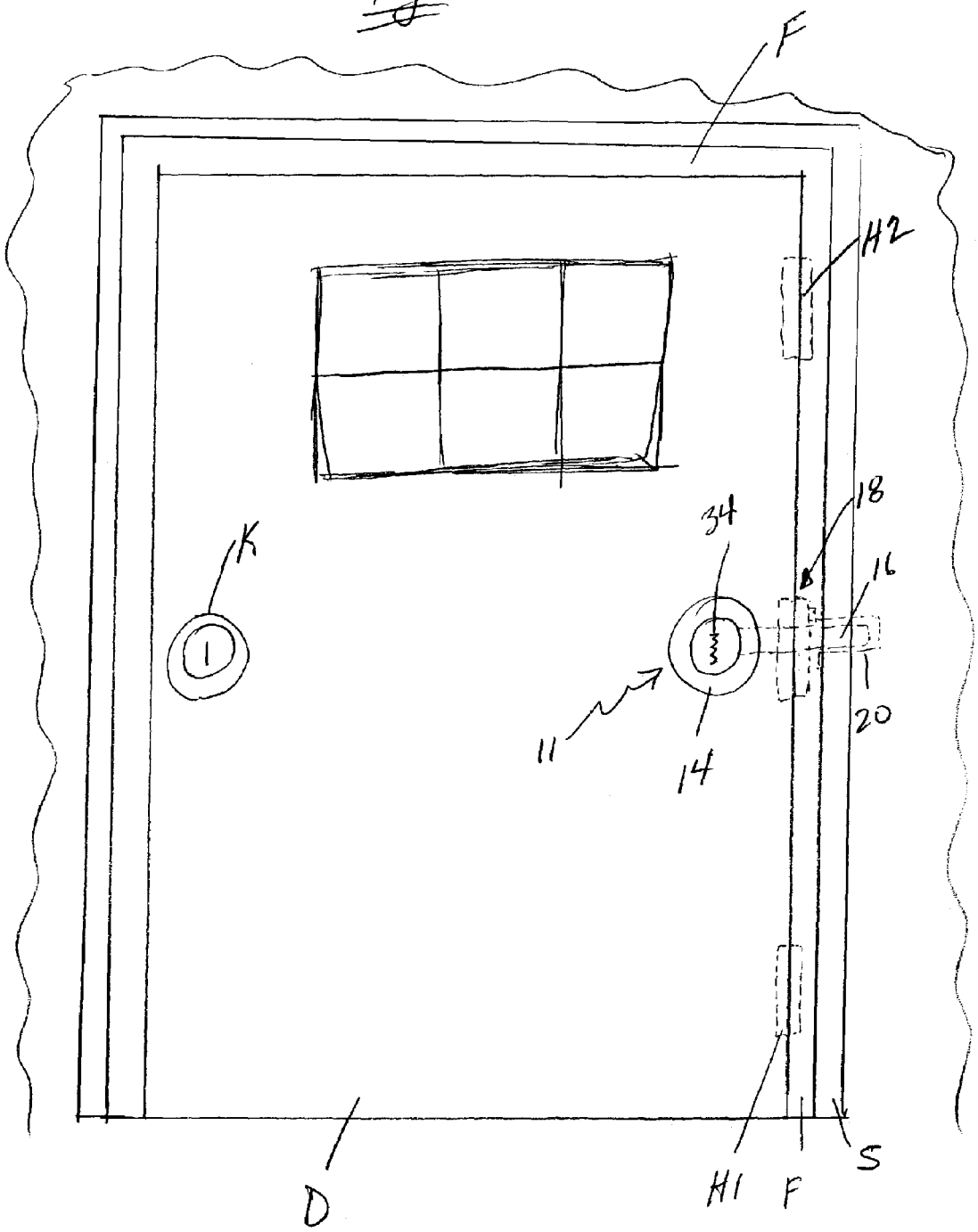
FIG. 1 shows an overview of one embodiment of the invention installed in a standard door with the standard door frame and door knob.

Referring to the drawings in detail wherein like elements are indicated by like numerals, there is shown in FIG. 1 an overview of the lock 11 installed in a door D having a knob K and a frame F. While this embodiment of the invention shows the lock 11 installed in the position of the middle hinge 18, it should be understood that it could also be installed at the top hinge H2 or bottom hinge H1, or all three hinges could have the separate locks 11 installed. Also shown in FIG. 1 is the dead bolt 14 connecting to the rod 16 which is housed in the receiver 20. In a typical installation, on the exterior of door D would be a dead bolt 14 and a key way 34. The key way 34 is connected to the rod 16 and the handle 28, the handle 28 is located on the interior of the door D. The rod 16 has a rod end 17.

Figure 2:
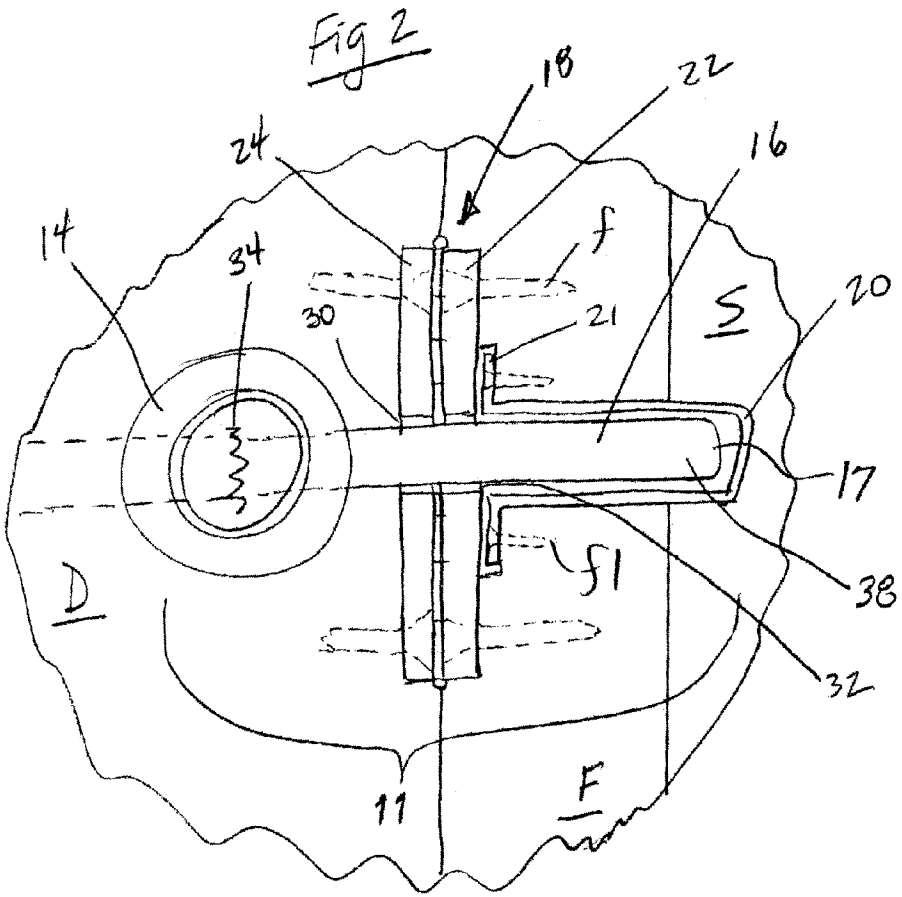
FIG. 2 shows a cutaway side view of one embodiment of the invention as installed with the door closed and locked.

FIG. 2 shows a cutaway side view of the lock 11 as typically installed in the door D frame F and stud S. This embodiment shows the rod 16 housed partly within the receiver 20, or the door locked. The receiver 20 extends through the frame F into the stud S, thus penetrating deeper than the conventional door knob K elements. The user would need to drill a hole through the frame F and stud S of a pre-determined diameter and depth such that the receiver 20 would fit into the hole.

Once the receiver 20 is seated in the hole, fasteners f1 can be used to secure the receiver in the frame F and stud S.

Figure 3:
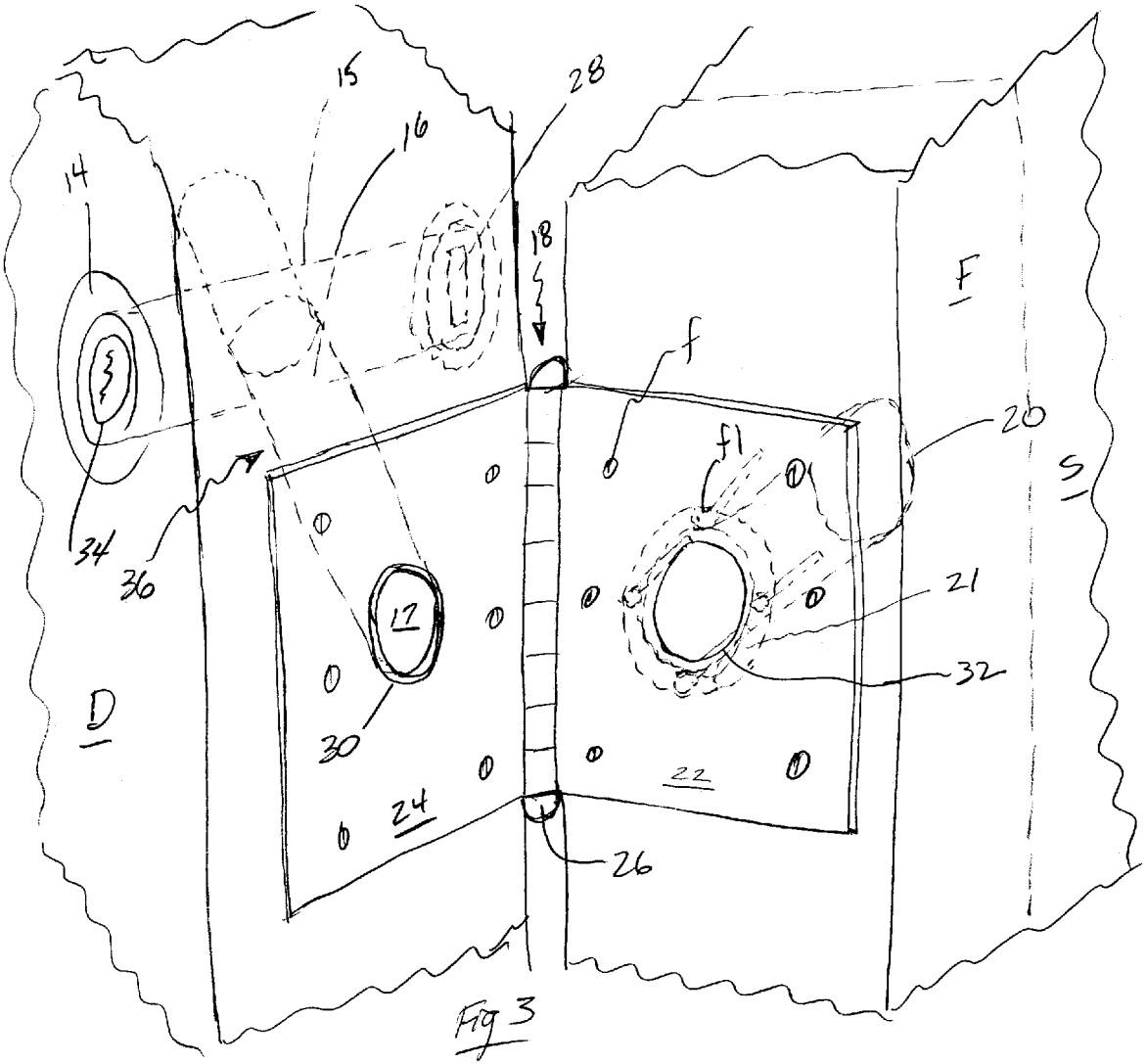
FIG. 3 shows a detailed perspective view of one embodiment of the invention as installed with the door open and lock unlocked.
Figure 6:
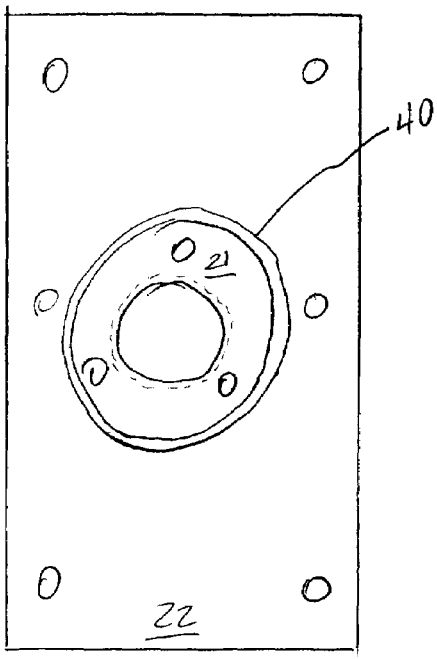
FIG. 6 shows a view of another embodiment of the frame plate and receiver.

FIG. 6 shows an alternative embodiments of the frame plate 22 and the receiver 20. In this particular embodiment, frame plate 22 has a cutout 40 for receiving the shoulder 21 of the receiver 20. The receiver could thus be fastened with fasteners f1 which run through the frame plate 22 and into the frame F and stud S as shown in FIG. 3.

Figure 7:
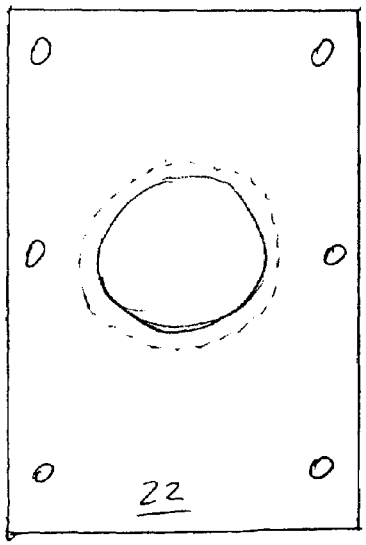
FIG. 7 shows a view of another embodiment of a one piece frame plate and receiver.

FIG. 7 shows another embodiment where the frame plate 22 and receiver 20 are combined into a one piece unit.

Figure 8:
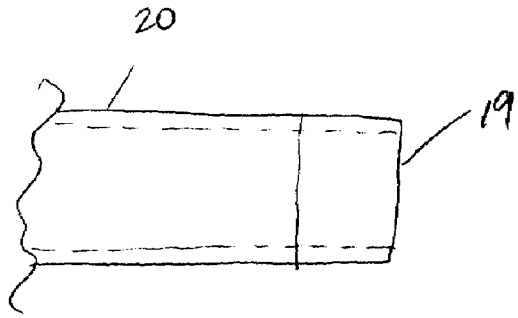
FIG. 8 shows a side view of another embodiment of the fist end of the receiver.
Figure 8A:
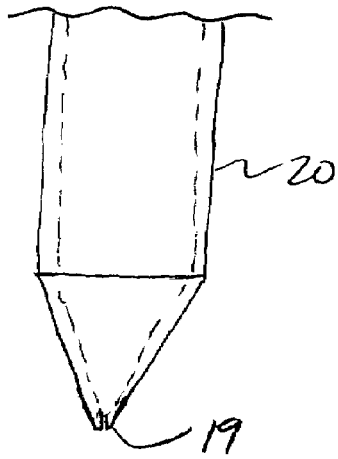
FIG. 8A shows a top view of the first end of the receiver in FIG. 8.

FIG. 8 and FIG. 8A show a side and top view respectively of the receiver 20 first end 19. In this embodiment, the first end 19 terminates in a vertical slot. This would allow the user to drill a hole through the frame F and most of the required depth into stud S and pound the first end 19 into the stud S further retaining the receiver 20 within the stud S.

Figure 9:
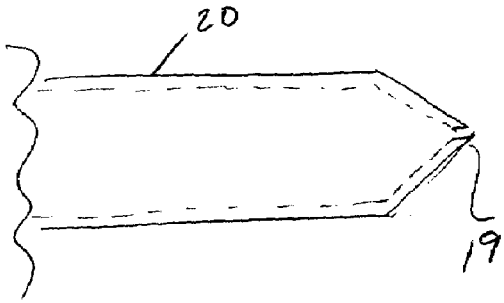
FIG. 9 shows a side view of another embodiment of the first end of the receiver.
Figure 9A:
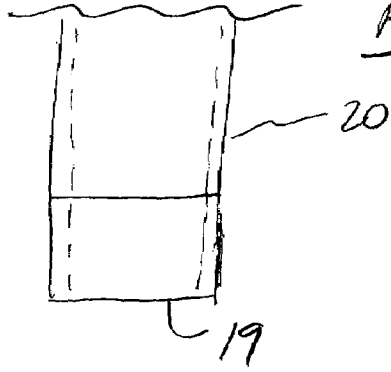
FIG. 9A shows top view of the first end of the receiver in FIG. 9.
Figure 10:
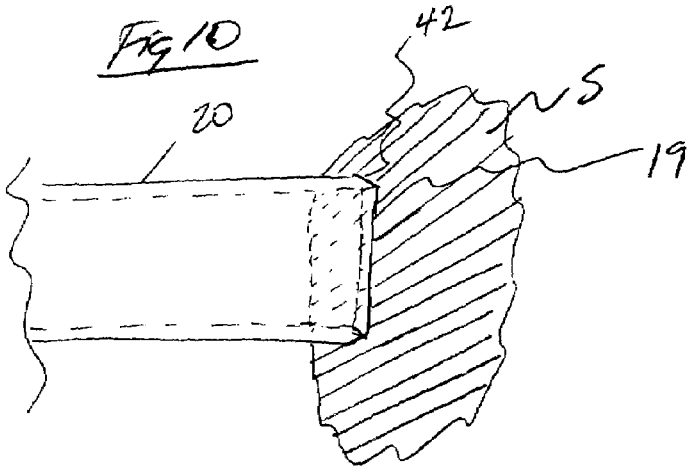
FIG. 10 shows another embodiment of the first end of the receiver.

Likewise, FIGS. 9 & 9A show an alternative embodiment of the receiver 20 first end 19. In this embodiment, the first end 19 is a vertical slot. The user would drill a hole through the frame F and most of the required depth into the stud S and pound the first end 19 into the stud S further retaining the receiver 20 within the stud S.

In this embodiment, a chamfer 42 is cut at the first end 19 so that when the first end is pounded into the stud S, the chamfer 42 cuts into the stud S which fills the receiver 20 substantially as shown.

Likewise door plate 24 could also have a receiver sleeve (not shown) similar to receiver 20 to strengthen the lock 11. The receiver sleeve would extend from the door plate 24 to near the cross member 15, FIG. 3. Any of the attachment methods shown in FIGS. 3,6, 6A, 7 or 7A could be used for the receiver sleeve.

Figure 6A:
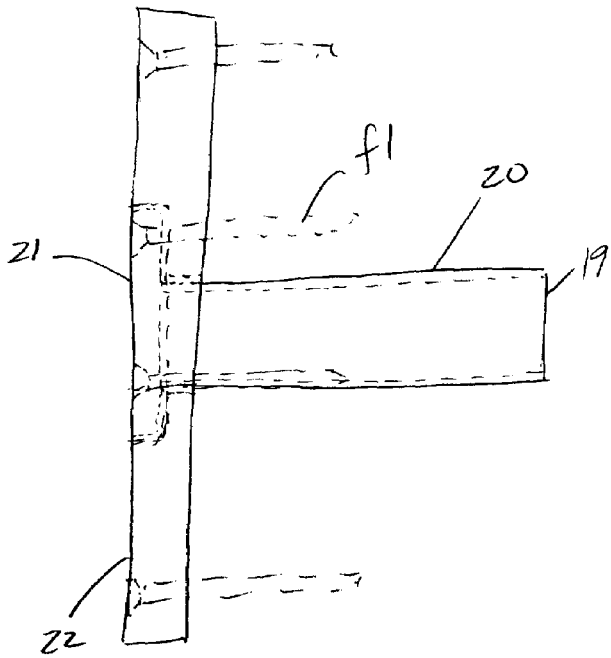
FIG. 6A shows a side view of the alternative embodiment of the frame plate and receiver of FIG. 6.
Figure 7A:
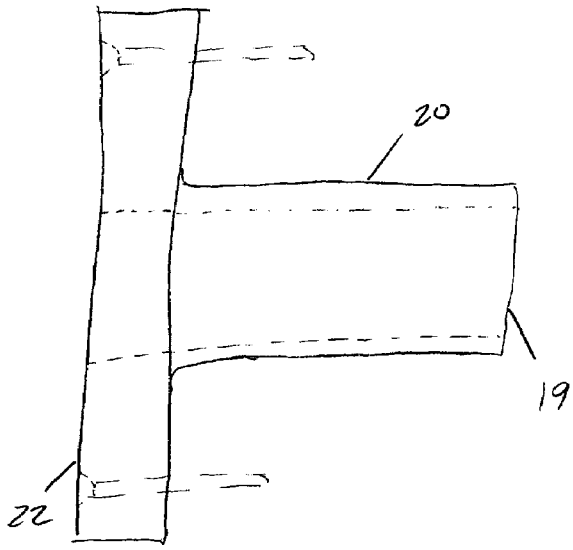
FIG. 7A shows a side view of the alternative embodiment of the one piece frame plate and receiver of FIG. 7.

It should be noted that any of the first end 19 embodiments shown could be used with any combination of the receiver 20, either the two piece embodiments as shown in FIGS. 6 & 6A, FIG. 2 or the single piece embodiment of FIGS. 7 & 7A.

The frame plate 22 could be the standard hinge that had been installed on a pre-existing door. If this were the case, the user would need to drill a hole through both the frame plate 22 and the door plate 24 at a specific location. Preferably, a new hinge would be provided with pre-drilled frame and door holes 32, 30 through both the frame plate 22 and the door plate 24. The user could then remove the existing hinge and replace it with the new hinge 18. A replacement hinge 18 would aid in alignment and installation with the other components of the lock 11.

FIG. 2 also shows the arrangement of the dead bolt 14 in the door D relative to the hinge 18. The rod 16 is connected to the dead bolt 14 and rotation of the dead bolt 14 when a key is placed in the key way 34 on the exterior and handle 28 on the interior (best seen in FIG. 4) causes a translational movement of the rod 16.

Figure 4:
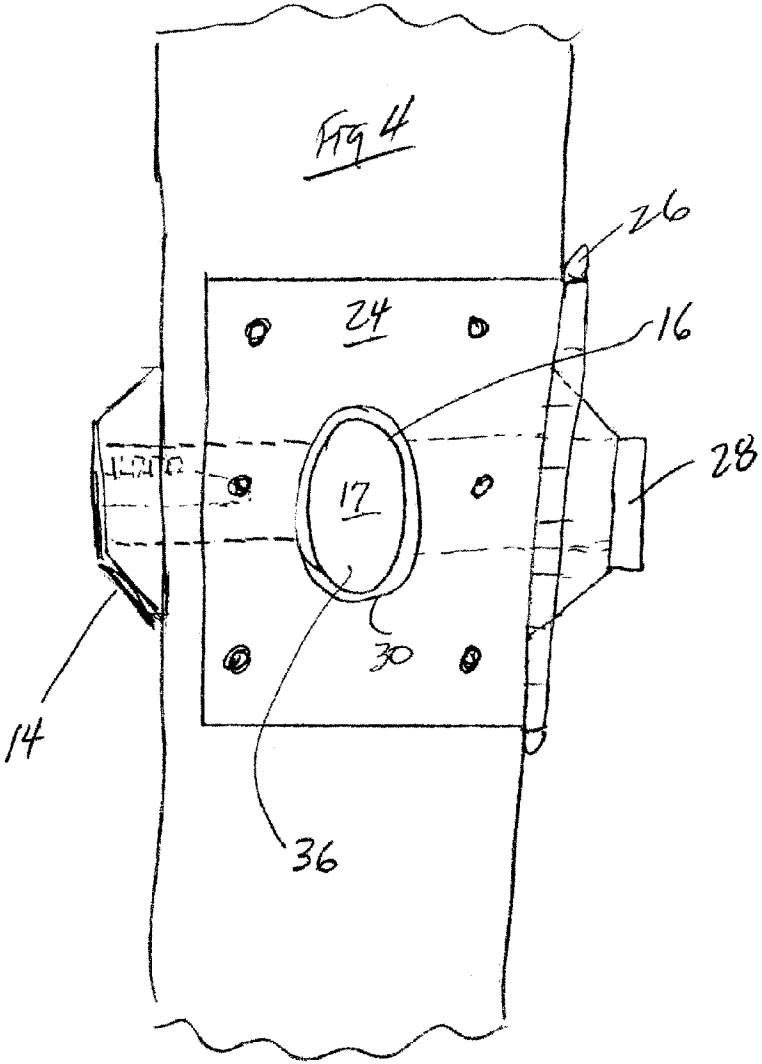
FIG. 4 shows a side view of one embodiment of the invention mounted on and in a standard door.

FIG. 4 shows an oblong rod 16. It should be recognized that the rod 16 could be of any shape such as circular, square, rectangular or of nearly any other shape without limitation. The rod 16 could be a different profile than that shown, such as a square, rectangle, star, oblong circle, triangle and any other. This different profile would necessitate that the door hole 30, frame hole 32 and receiver 20 would have to correspond in shape or be designed such that the lock 11 would still function. The shape of the rod 16 shown is meant to be but one embodiment and not a limitation.

As the key is turned in the key way 34 of the dead bolt 14, the rod 16 moves from within the door D or first position 36 through the door plate 24, the frame plate 22 and into the receiver 20 to a second position 38. In the second position 38, the rod 16 is contained partly within the door D and through the door plate 24, frame plate 22 and partly within the receiver 20, best shown in FIG. 2.

Once the maximum distance is reached, the user removes the key from the dead bolt 14, the rod is housed in the receiver 20 and the lock 11 severely discourages the door D from opening unless one has a key or someone is inside to open the lock 11.

Figure 5:
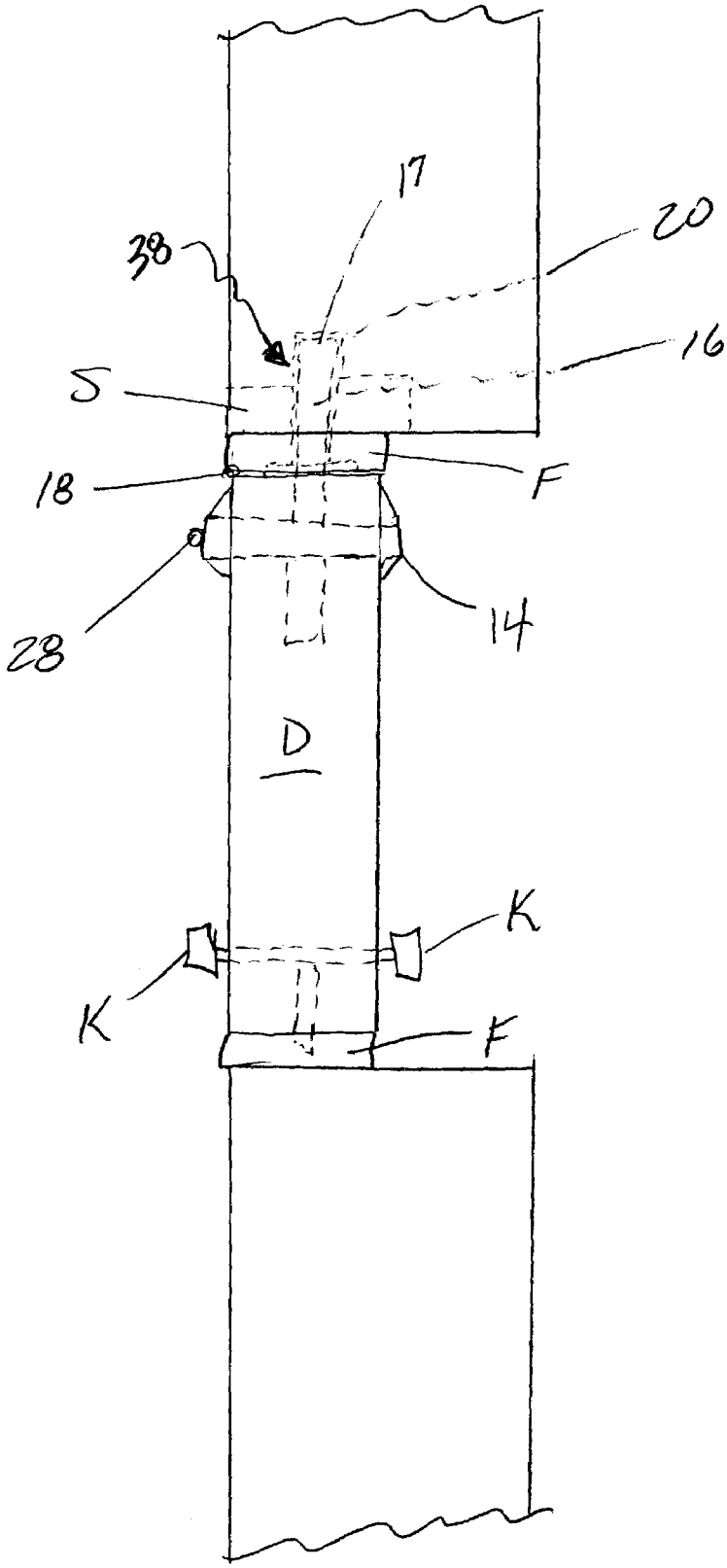
FIG. 5 shows a top view of one embodiment of the invention mounted in a typical door, frame and stud.

If some unwanted person was to try to open the door D with the rod 16 housed in the receiver 20, they would have to break the rod 16 and receiver 20 through the frame and the stud S. Alternatively, with respect to FIG. 5, the handle 28 would have to be pulled through the door D to force open the door D. In typical exterior installations of doors D, trying to force the door D with the lock 11 installed would also require that the rod 16 be forced through the siding and/or brick to gain entry, best shown in FIG. 5.

If a person is on the inside of the door, the handle 28 can be turned and the rod 16 is removed from the receiver 20 (or second position 38), then the frame plate 22, and the door plate 24 to reside within the door D (First position 36). The door D can then be opened and closed as a normal door is; provided no other security devices are being utilized. Other handles or even a keyed handle 28 could be used on the interior of the door also.

A person could also gain entry of a locked door D with a lock 11 installed by inserting the key into the dead bolt 14 and turning the dead bolt to remove the rod 16 from the receiver 20 or second position 38, frame plate 22, and door plate 24 to be housed within the door D, first position 36. The door would then operate as a normal door provided the user has installed no other security devices.

As an alternative, the dead bolt 14 could have a handle (not shown) and combination lock (not shown) installed replacing the key way 34 of the dead bolt 14, or a magnetic card and slot (neither shown) and many other devices for restricting access to specific persons that are known in the art.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. A lock for increasing the security of a hinged door assembly having a frame and a stud, the lock comprising:

a dead bolt having a key way and a handle, the dead bolt attached to the door near the hinged edge of the door;

a translatable rod connected to the dead bolt and interconnected with the key way and the handle;

a hinge having a frame plate attached to the frame and a door plate attached to the door, a frame hole in the frame plate and a door hole in the door plate;

a receiver fastened to the frame and adjacent to the frame plate, the receiver penetrating the frame; and whereby a key can be rotated in the keyway in one direction for translating the rod from a first position within the door through the door plate, frame plate and into the receiver to a second position such that the door is prevented from opening and the key can be rotated in the keyway in a second direction for translating the rod from the second position within the receiver, the frame plate and door plate to the first position within the door such that the door can open.

2. The receiver of claim 1, wherein:

the receiver is located between the frame plate and the frame and fastened to the frame.

3. The receiver of claim 1, wherein:

the shoulder of the receiver is located between the frame plate and the door plate and fastened to the frame.

4. The receiver of claim 1, wherein:

the receiver penetrates through the frame and is partially housed in the stud.

5. The rod of claim 1, wherein:

selective rotation of the handle translates the rod from the first position to the second position and from the second position to the first position.

6. A lock for increasing the security of a hinged door assembly having a frame and a stud, the lock comprising:

a dead bolt having a key way on the exterior of the door and a handle on the interior of the door, the dead bolt attached to the door near the hinged edge of the door;

a hinge having a frame plate attached to the frame and a door plate attached to the door, a frame hole in the frame plate and a co-linear door hole in the door plate;

a receiver fastened to the frame and penetrating the frame, the receiver located adjacent to the frame plate;

a moveable rod connected to the dead bolt for translation between a first position completely within the door to a second position partly within the receiver, and partly within the door; and whereby a key can be rotated in the keyway in one direction for translating the rod from the first position completely within the door through the door hole, frame hole and into the receiver such that the rod is in a second position and contained partly within the door and partly within the receiver and the door will not open, and the key can be rotated in the keyway in a second direction for translating the rod from the second position within the receiver through the frame hole, the door hole and completely into the door such that the door can be opened.

7. The receiver of claim 6, further comprising:

a cutout in the frame plate for housing the receiver where the receiver is attached with fasteners through the frame plate to the frame.

8. The receiver of claim 6, wherein:

the receiver is inserted through the frame to penetrate the stud.

9. The receiver of claim 6, further comprising:

the receiver having a chamfer on a first end for aiding in penetrating the stud.

10. The rod of claim 6, wherein:

selective rotation of the handle translates the rod from the first position to the second position and from the second position to the first position.

11. A lock for a hinged door assembly having a frame and a stud, the lock comprising:

a dead bolt having a key way on the exterior of the door and a handle on the interior of the door;

a rod interconnected to the dead bolt, the rod having a rod end and the rod translatable from a first position to a second position and from the second position back to the first position;

a hinge having a door plate attached to the door and a frame plate attached to the frame, the door plate and frame plate interconnected by a pin;

a receiver having a shoulder, the receiver located adjacent to the frame plate, the receiver inserted and housed in the frame; and whereby a key can be inserted and rotated in the keyway in one direction for translating the rod from a first position contained within the door through the door plate and frame plate to a second position where the rod is contained partially within the receiver and the door such that the door will not open, and the key can be rotated in a second direction for translating the rod from the second position partially contained within the receiver and door through the frame plate and door plate to the first position where the rod is contained within the door such that the door will open.

12. The receiver of claim 11, further comprising:

a cutout in the frame plate for housing the shoulder of the receiver where the receiver is attached with fasteners through the frame plate to the frame.

13. The door plate and frame plate of claim 11, further comprising:

a door hole in the door plate and a frame hole in the frame plate.

14. The receiver of claim 11, wherein:

the shoulder of the receiver is located between the frame plate and the door plate and fastened to the frame.

15. A lock for increasing the security of a hinged door assembly having a frame and a stud, the lock comprising:

a dead bolt having a key way and a handle, the dead bolt attached through the door near the hinged edge of the door;

a translatable rod interconnected with the key way and handle;

a hinge having a frame plate attached to the frame and a door plate attached to the door, a frame hole in the frame plate and a door hole in the door plate;

a receiver affixed to the frame plate, the receiver penetrating the frame; and whereby a key can be rotated in the keyway in one direction for translating the rod from a first position within the door through the door plate, frame plate and into the receiver to a second position such that the door is prevented from opening and the key can be rotated in the keyway in a second direction for translating the rod from the second position within the receiver, through the frame plate and door plate to the first position within the door such that the door can open.

16. The receiver of claim 15, further comprising:

the receiver having a chamfer on a first end for penetrating the stud.

17. The receiver of claim 15, wherein:

the receiver penetrates through the frame and is partially housed in the stud.

18. The rod of claim 15, wherein:

selective rotation of the handle translates the rod from the first position to the second position and from the second position to the first position.

19. The receiver of claim 15, wherein:

the receiver penetrates through the frame and is partially housed in the stud.

* * * * *